US008454306B2

(12) United States Patent
Mokulys et al.

(10) Patent No.: US 8,454,306 B2
(45) Date of Patent: Jun. 4, 2013

(54) STEAM TURBINE

(75) Inventors: Thomas Mokulys, Wuerenlingen (CH); Vishal Borikar, Nussbaumen (CH); Giorgio Zanazzi, Baden (CH); Davor Kriz, Baden (CH); Hans-Ludwig Boxheimer, Rieden (CH); Luca Ripamonti, Rieden (CH); Maurus Herzog, Schinznach-Dorf (CH); Martin Reigl, Ehrendingen (CH); Rolf Doebler, Schriesheim (DE); Jozo Drmic, Nussbaumen (CH); Jian Chen, Brugg (CH); Rabiye Bekyigit, Wald-Michelbach (DE)

(73) Assignee: ALSTOM Technology Ltd., Baden (CH)

( * ) Notice: Subject to any disclaimer, the term of this patent is extended or adjusted under 35 U.S.C. 154(b) by 855 days.

(21) Appl. No.: 12/622,823

(22) Filed: Nov. 20, 2009

(65) Prior Publication Data

US 2010/0129207 A1 May 27, 2010

(30) Foreign Application Priority Data

Nov. 26, 2008 (CH) ..... 1847/08

(51) Int. Cl.
*F01D 5/18* (2006.01)

(52) U.S. Cl.
USPC ..... 415/178; 415/184

(58) Field of Classification Search
USPC ..... 415/178, 180, 184, 205; 416/144
See application file for complete search history.

(56) References Cited

U.S. PATENT DOCUMENTS 2,467,818 A * 4/1949 Elston ..... 415/108
6,082,962 A * 7/2000 Drosdziok et al. ..... 415/115

FOREIGN PATENT DOCUMENTS

DE 3406071 8/1984
DE 19620828 9/1997

(Continued)

OTHER PUBLICATIONS

Search Report for German Patent App. No. 10 2009 053 447.4 (Nov. 11, 2010).

(Continued)

*Primary Examiner* — Dwayne J White
(74) *Attorney, Agent, or Firm* — Cermak Nakajima LLP; Adam J. Cermak

(57) ABSTRACT

A steam turbine (10), especially for the high-pressure range or intermediate-pressure range, includes a rotor (11) which is rotatably mounted around an axis and concentrically enclosed at a distance by an inner casing (12), wherein between the rotor (11) and the inner casing (12) a flow passage (13) is formed, which on the inlet side is axially delimited by a balance piston (18) which is arranged on the rotor (11), and into which flow passage rotor blades (15) and stator blades (17), alternating in the direction of flow, radially project, and wherein, at the entry of the flow passage (13), an inlet scroll (14), through which steam is guided from the outside radially inwards and deflected in a deflection region (27) in the axial direction to the inlet of the flow passage (13), is formed on the inner casing (12). A reduction of the thermal loads and stresses is achieved by a stress-relief slot (20) in the deflection region (27) upstream of the first rotor blade row (15) for reducing stresses in the fastening slot (16) of the first rotor blade row (15) in the rotor (11), and by a heat shield (21) arranged in the region of the stress-relief slot (20) for protecting the rotor (11) against high temperatures.

6 Claims, 2 Drawing Sheets

FOREIGN PATENT DOCUMENTS

| | | |
|---|---|---|
| EP | 1455066 | 9/2004 |
| EP | 1724437 | 11/2006 |
| EP | 1911933 | 4/2008 |
| EP | 2031183 | 3/2009 |
| JP | 60-159304 | 8/1985 |
| WO | W02006/048401 | 5/2006 |

OTHER PUBLICATIONS

Search Report for Swiss Patent App. No. 1847/2008 (Jul. 10, 2009).

* cited by examiner

STEAM TURBINE

This application claims priority under 35 U.S.C. §119 to Swiss application no. 01847/08, filed 26 Nov. 2008, the entirety of which is incorporated by reference herein.

BACKGROUND

1. Field of Endeavor

The present invention relates to the field of thermal machines, and more particularly to a steam turbine.

2. Brief Description of the Related Art

In FIG. 1, a detail of a greatly simplified view of the standard construction of a steam turbine for the high-pressure (HP) range and intermediate-pressure (IP) range is reproduced. The steam turbine 26 of FIG. 1 includes a rotor 11 which is rotatably mounted around an axis and concentrically enclosed at a distance by an inner casing 12. Between the rotor 11 and the inner casing 12 an (axial) annular, customarily bladed flow passage 13 is formed, by which the supplied steam is expanded during operation. The flow passage 13 on the inlet side is delimited in the axial direction by an especially formed-on balance piston 18 which is arranged on the rotor 11 and provided for balancing the axially acting forces. The balance piston 18 is sealed in relation to the inner casing 12 by a piston seal 19. Rings of rotor blades 15 and stator blades 17, which alternate in the flow direction, project radially into the flow passage 13. At the entry of the flow passage 13 an (encompassing) inlet scroll 14, by which the steam is guided from the outside radially inwards and deflected in a deflection region 27 in the axial direction to the inlet of the flow passage 13, is formed on the inner casing 12. The stator blades 17 are fastened on the inner casing 12 in a way which is not described in more detail. The rotor blades 15 are fastened by blade roots in each case in encompassing fastening slots 16 on the rotor 11.

At very high operating temperatures (for example in the case of ultra-supercritical (USC) steam processes and 700° C. machines), the thermal stresses in the rotor 11, and particularly in the fastening slots 16 of the rotor blades 15 there, become very large. It has therefore already been considered to provide a so-called stress-relief slot (20 in FIG. 2) in the deflection region 27 of the rotor 11 upstream of the first fastening slot 16 in order to relieve the thermal stresses in this region. It has been observed, however, that such a stress-relief slot causes high aerodynamic losses if it is located in the flow path. If the stress-relief slot on the other hand is shifted into the region of the piston seal 19 either the effect of the seal is reduced or the entire machine has to be constructed longer in the axial direction, or the stress relief of the stress-relief slot is reduced.

SUMMARY

One of numerous aspects of the present invention relates to a steam turbine for the intermediate-pressure range or high-pressure range which can avoid the aforementioned disadvantages of previous solutions. In particular, relief of the rotor from thermal stresses in the inlet region can be achieved without impairing other characteristics of the machine.

Another aspect includes that a stress-relief slot is provided in the deflection region upstream of the first rotor blade row for reducing stresses in the fastening slot of the first rotor blade row in the rotor, and a heat shield is arranged in the region of the stress-relief slot for protecting the rotor against high temperatures. As a result of the combination of stress-relief slot and heat shield in the region of the stress-relief slot, thermal stresses are relieved and the surface of the rotor in this region is protected against excessively high temperatures at the same time. Furthermore, the possibility of an additional seal and cooling in the region of the heat shield is opened up.

One development is characterized in that the heat shield is formed in a curved manner for deflecting the steam from the radial into the axial direction.

Another development is characterized in that the heat shield is fastened on the inner casing and merges into the stress-relief slot without directly contacting of the rotor. In particular, the balance piston is sealed against the inner casing by a piston seal, and the heat shield is sealed against the rotor by an additional seal. As a result of the additional seal on the heat shield, possible losses at the piston seal can be at least compensated.

According to another development of the invention, however, it is also conceivable that the balance piston is sealed against the inner casing by a piston seal, that the heat shield abuts against the rotor, forming an annular gap, and that, for cooling of the rotor in the region of the stress-relief slot, provision is made for a feed line for injecting a cooling medium, especially cooling steam, under high pressure into an interspace between the balance piston and the heat shield.

A further development is characterized in that the heat shield extends from the inlet scroll to the downstream-located edge of the stress-relief slot and interfaces in a flush manner both in the region of the inlet scroll and at the inlet of the flow passage, wherein the heat shield reproduces the circumferential contour of the rotor which is altered as a result of the stress-relief slot.

BRIEF DESCRIPTION OF THE DRAWINGS

The invention shall subsequently be explained in more detail based on exemplary embodiments in conjunction with the drawing. In the drawing.

DETAILED DESCRIPTION OF EXEMPLARY EMBODIMENTS

Figure 1:
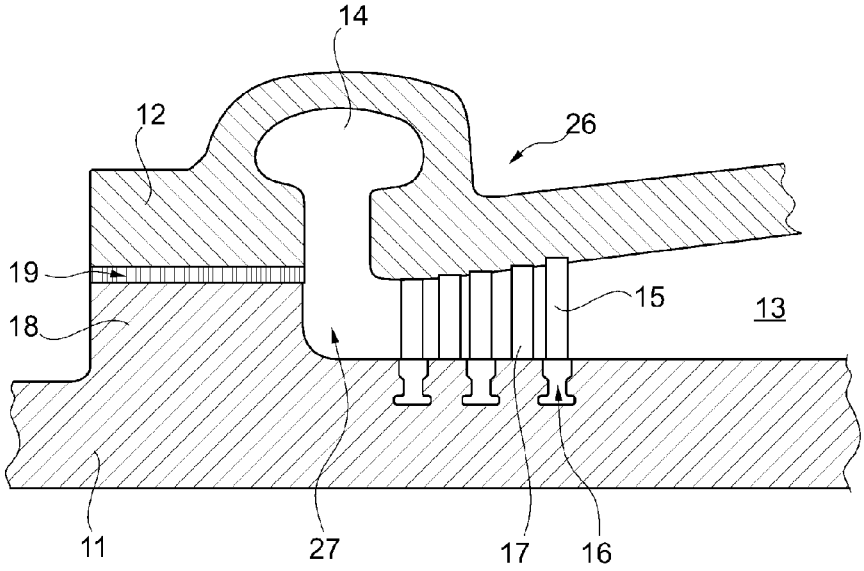
Fig. 1 (prior art)
FIG. 1 shows, in a detail of a simplified view, a standard construction of a steam turbine for the high-pressure range or intermediate-pressure range.
Figure 2:
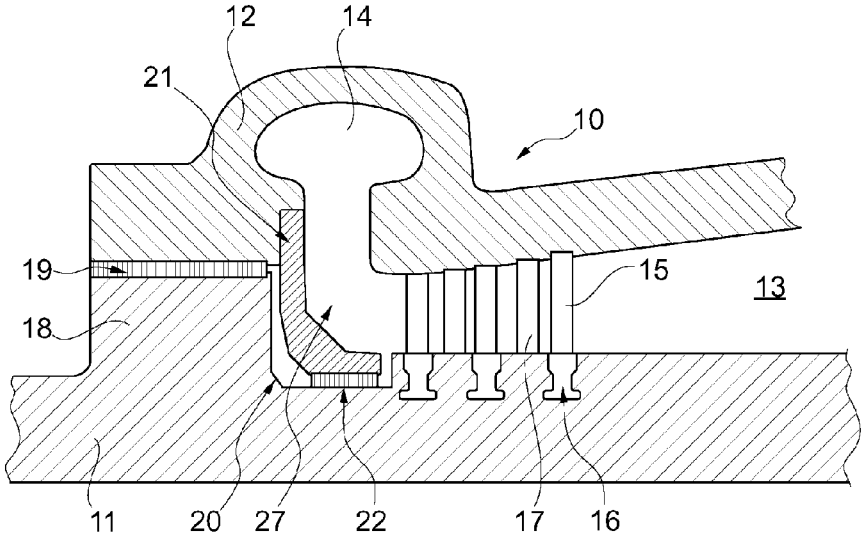
FIG. 2 shows, in a view which is comparable to FIG. 1, a steam turbine with stress-relief slot and heat shield according to a first exemplary embodiment of the invention.

In FIG. 2, in a view which is comparable to FIG. 1, a first exemplary embodiment of the invention is shown. The steam turbine 10 of FIG. 2 differs from the steam turbine 26 from FIG. 1 by the fact that an encompassing stress-relief slot 20 is provided in the deflection region 27 upstream of the first row of rotor blades 15 for reducing stresses in the fastening slot 16 of the first rotor blade row in the rotor 11. A heat shield 21, which is provided for protecting the rotor 11 against the high temperatures of the inflowing steam and for improving the aerodynamics, projects into the stress-relief slot 20. The stress-relief slot 20 relieves thermal and mechanical stresses in the region of the fastening slot 16 of the first rotor blade row, while the curved heat shield 21, despite the stress-relief slot 20, maintains the geometry of the inflow region largely without alteration, and effectively shields the rotor 11 in the region of the stress-relief slot 20 against excessively high temperatures.

The heat shield 21, as shown in FIG. 2, can be formed as a separate part which is fastened by screws or the like on the inner casing 12. It is also conceivable, however, for the heat shield 21 to be constructed as an integral cast part of the inner casing 12.

If an additional seal 22 is provided between the heat shield 21 and the bottom of the stress-relief slot 20, as shown in FIG. 2, although the piston seal 19 is shortened as a result of the heat shield 21 the sealing effect compared with the configuration from FIG. 1 is unaltered or even improved.

The heat shield 21 preferably extends from the inlet scroll 14 to the downstream-located edge of the stress-relief slot 20, wherein it interfaces in a flush manner both in the region of the inlet scroll 14 and at the inlet of the flow passage 13. As a result of this, the aerodynamic conditions compared with FIG. 1 are only minimally altered or not altered at all.

The steam which flows in through the additional seal 22 into the stress-relief slot 20 is colder on account of the expansion at the additional seal 22. Therefore, the temperature of the rotor surface in this region is reduced. Independently of this, the cross-sectional contour of the stress-relief slot 20 can be optimized with regard to the reduction of the stresses in the fastening slots 16.

A radial step can additionally be provided in the inlet region, as is disclosed, for example, in WO-A1-2006/048401. For this, the diameter of the inlet scroll then possibly has to be increased. Instead, the inlet stage of the rotor could also be correspondingly designed in order to be adapted to the additional uniformity of the flow.

The exemplary embodiment according to FIG. 2 has the following advantages:

- reduction of the stresses in the rotor on account of the stress-relief slot;
- reduction of the temperatures on the rotor in the deflection region and in the stress-relief slot, and
- a very good sealing effect.

Opposed to this is the requirement for additional parts, and also a possible enlarging of the machine and re-dimensioning of the balance piston. Also, the integration of a radial step involves additional cost.

Figure 3:
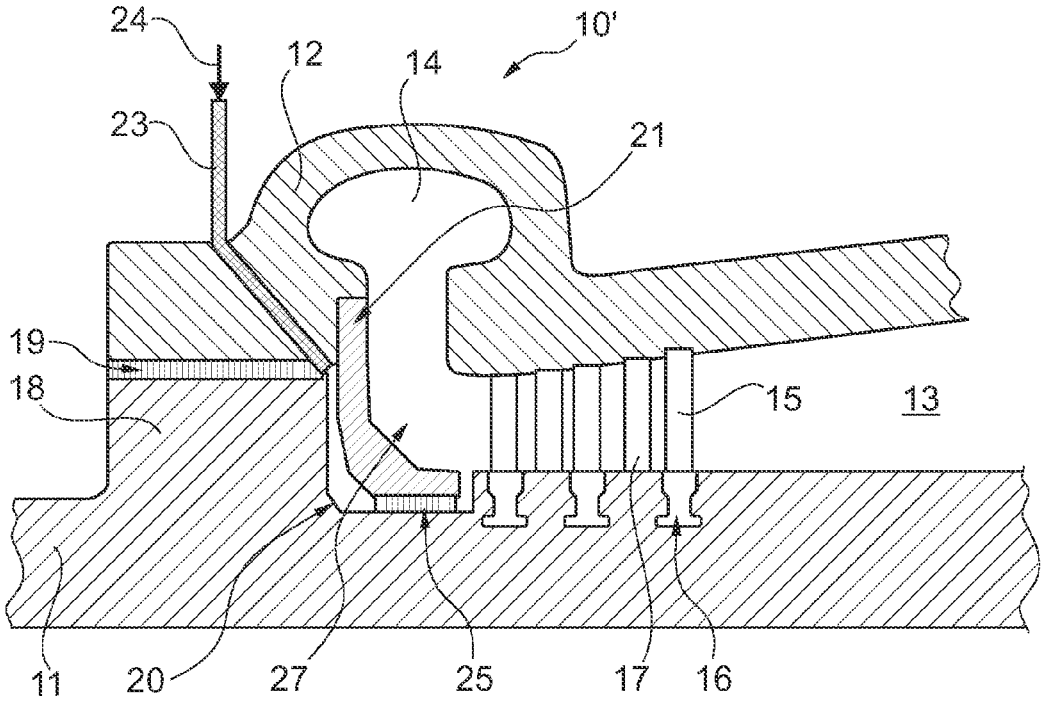
FIG. 3 shows, in a view which is comparable to FIG. 1, a steam turbine with stress-relief slot and heat shield according to a second exemplary embodiment of the invention.

In the case of the exemplary embodiment of FIG. 3, in the steam turbine 10' there compared with FIG. 2, the additional seal between heat shield 21 and stress-relief slot 20 is dispensed with so that an open annular gap 25 exists between the two. As a result of this, the full steam pressure again reaches the balance piston 18 so that the compensating action of the balance piston is fully maintained even without re-dimensioning. On the other hand, however, as a result of the omission of the additional seal the temperature in the region of the stress-relief slot 20 increases again. In order to avert this effect, according to FIG. 3 provision can be made to inject cooling steam 24 under high pressure through a feed line 23 in the inner casing 12 into the stress-relief slot 20. As a result of the injected cooling steam 24, a particularly good cooling of the rotor surface in the region of the stress-relief slot 20 and of the subsequent blade fastenings is achieved since the cooling steam can discharge through the annular gap 25 into the flow passage 13. In order to achieve the same sealing effect as in the case of the exemplary embodiment of FIG. 2, despite the omission of the additional seal 22, the piston seal 19 would have to be correspondingly extended in the axial direction.

The exemplary embodiment according to FIG. 3 therefore has the following advantages:

- reduction of the stresses in the rotor on account of the stress-relief slot;
- reduction of the temperatures on the rotor in the deflection region and in the stress-relief slot;
- a good sealing effect;
- an adjustable axial pressure with the same dimensions of the balance piston;
- a heat shield which is not exposed to an axial pressure and can therefore be constructed thinner, and
- significant reduction of the temperatures in the labyrinth seal.

Opposing this is the requirement for additional parts, and also a possible enlarging of the machine. The integration of a radial step involves additional cost and cooling steam will additionally have to be branched off or made available within the process.

List of Designations

10, 10', 26 Steam turbine
11 Rotor
12 Inner casing
13 Flow passage (annular passage)
14 Inlet scroll
15 Rotor blade
16 Fastening slot
17 Stator blade
18 Balance piston
19 Piston seal
20 Stress-relief slot
21 Heat shield (curved)
22 Additional seal
23 Feed line
24 Cooling steam
25 Annular gap
27 Deflection region While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A steam turbine for high-pressure range or intermediate-pressure ranges, the steam turbine comprising:

an inner casing having radially extending stator blades;

a rotor rotatably mounted around an axis and concentrically enclosed at a distance by the inner casing, the rotor including rotor blades and a balance piston;

a flow passage formed between the rotor and the inner casing, the flow passage having an inlet axially delimited by the balance piston, the rotor blades and stator blades, alternating in the direction of flow, radially projecting into the flow passage;

an inlet scroll at an entry of the flow passage through which steam can be guided from the outside radially inwards and deflected in a deflection region in the axial direction to the flow passage inlet, the inlet scroll being formed on the inner casing;

a stress-relief slot in the deflection region upstream of a first rotor blade row configured and arranged to reduce stresses in a fastening slot of the first rotor blade row in the rotor;

a heat shield in the region of the stress-relief slot configured and arranged to protect the rotor against high temperatures; and wherein the heat shield is fastened on the inner casing and merges into the stress-relief slot without direct contact with the rotor.

2. The steam turbine as claimed in claim 1, wherein the heat shield is curved such that steam is deflected from the radial into the axial direction.

3. The steam turbine as claimed in claim 2, wherein the heat shield extends from the inlet scroll to a downstream-located edge of the stress-relief slot and is flush both with the inlet scroll and with the rotor at the flow passage inlet.

4. The steam turbine as claimed in claim 3, wherein the heat shield reproduces a circumferential contour of the rotor at the stress-relief slot.

5. The steam turbine as claimed in claim 1, further comprising:

a piston seal which seals the balance piston against the inner casing; and an additional seal which seals the heat shield against the rotor.

6. The steam turbine as claimed in claim 1, further comprising:

a piston seal which seals the balance piston against the inner casing;

wherein the heat shield is spaced from and forms an annular gap with the rotor, and the balance piston is spaced from and forms an interspace with the heat shield; and a feed line in the region of the stress-relief slot configured and arranged to inject a cooling medium under high pressure into the interspace.

* * * * *